US008085215B2

(12) United States Patent
Li

(10) Patent No.: US 8,085,215 B2
(45) Date of Patent: Dec. 27, 2011

(54) BASE STATION ANTENNA PROTECTION SYSTEM AND METHOD THEREOF

(75) Inventor: Fan Li, Shanghai (CN)

(73) Assignee: Inventec Appliances Corp., Taipei (TW)

( * ) Notice: Subject to any disclaimer, the term of this patent is extended or adjusted under 35 U.S.C. 154(b) by 541 days.

(21) Appl. No.: 12/370,791

(22) Filed: Feb. 13, 2009

(65) Prior Publication Data

US 2009/0201218 A1 Aug. 13, 2009

(30) Foreign Application Priority Data

Feb. 13, 2008 (TW) ..... 97105081 A

(51) Int. Cl.
*H01Q 3/02* (2006.01)
*H01Q 1/42* (2006.01)

(52) U.S. Cl. ..... 343/882; 343/872

(58) Field of Classification Search ..... 343/882, 343/720, 872
See application file for complete search history.

(56) References Cited

U.S. PATENT DOCUMENTS 7,053,859 B2 * 5/2006 Jackson et al. ..... 343/882
7,183,996 B2 * 2/2007 Wensink ..... 343/890
2005/0282586 A1 * 12/2005 Rutherford et al. ..... 455/562.1

* cited by examiner

*Primary Examiner* — Jacob Y Choi
*Assistant Examiner* — Hasan Islam
(74) *Attorney, Agent, or Firm* — WPAT, P.C.; Anthony King

(57) ABSTRACT

The present invention discloses a base station antenna protection system and the method thereof. The base station antenna protection system receives a wind moving in a direction, and comprises a base station antenna, a sensor, a protective surface and a rotatory device. The sensor is coupled to the base station antenna to detect a deviation of the base station antenna on the direction of the wind. A side of the protective surface is opposite to the base station antenna. The rotatory device is coupled to the protective surface. When the deviation exceeds a predetermined value, the rotatory device rotates the protective surface to cause another side of the protective surface to be opposite to the wind.

12 Claims, 3 Drawing Sheets

BASE STATION ANTENNA PROTECTION SYSTEM AND METHOD THEREOF

FIELD

The present invention relates to a base station antenna protection system and the method thereof, and more particularly to a base station antenna protection system using a sensor and the method thereof.

BACKGROUND

Nowadays, different sizes of base station antennas have been installed in many buildings or highlands for receiving and transmitting various wireless signals. It is necessary to transmit most of the wireless communication signals, wireless network signals, wireless television signals or the like to the devices such as users' mobile phones, wireless network equipments or television sets etc. via base station antennas. Therefore, base station antennas influence daily lives of people to a very great extent. If base station antennas are damaged by an external force and thus cannot transmit wireless signals, it may result in the inconvenience of the interruption of external wireless communications, the inability to receive instant messages or to link networks.

In general, those which influence base station antennas are principally typhoons or wind gusts. Particularly, typhoons have great destructive power such that base station antennas are often damaged during typhoons, and typhoons also often result in considerable losses to the suppliers or the governments. Even the interruption of wireless communications would make a user unable to call for help and thus cause hazards to the user or others who need help. However, currently, there doesn't exist a good solution to protecting base station antennas. With regard to this, how to protect base station antennas from being damaged that would result in the interruption of wireless signals when subjected to typhoons or wind gusts, and thus providing more protection to the suppliers and users has become a very important subject.

As a result of a variety of extensive and intensive studies and discussions to solve the drawbacks of the prior art and satisfy the demand of users for base station antenna protection systems, the inventors herein propose a base station antenna protection system and the method thereof based on their research for many years and plenty of practical experience, thereby accomplishing the foregoing expectations.

SUMMARY

In view of the above problems, an objective of the present invention is to provide a base station antenna protection system and the method thereof, particularly using a sensor to detect a deviation of the center of gravity of the base station antenna and then using a rotatory device to rotate a protective surface to cause the protective surface to be opposite to the wind so as to protect the base station antenna from being damaged by the wind, thus satisfying the demand of users for the protection of base station antennas and simultaneously solving the drawbacks of the prior art. In addition to detecting the magnitude of a wind, the protection system can automatically rotate the protective surface to a position against the direction of the wind and can withdraw the protective surface to avoid disrupting signal reception. Also, it is both economical and serviceable because only one protective surface is required.

Accordingly, to achieve the above objective, the present invention provides a base station antenna protection system that receives a wind moving in a direction, comprising a base station antenna, a sensor, a protective surface and a rotatory device. The sensor is connected to the base station antenna to detect a deviation of the base station antenna on the direction of the wind. A side of the protective surface is opposite to the base station antenna. The rotatory device is connected to the protective surface. When the deviation exceeds a predetermined value, the rotatory device rotates the protective surface to cause another side of the protective surface to be opposite to the wind.

Further, the present invention provides a base station antenna protection method comprising the following steps:

(a) Providing a base station antenna protection system that comprises a base station antenna, a sensor and a protective surface, a side of the protective surface is opposite to the base station antenna.

(b) Causing the base station antenna protection system to receive a wind moving in a direction.

(c) Detecting by the sensor a deviation of the base station antenna on the direction of the wind.

(d) Determining whether the deviation exceeds a predetermined value or not.

(e) If determining that the deviation exceeds the predetermined value, rotating the protective surface to cause another side of the protective surface to be opposite to the wind.

In order that the technical features and effects of the present invention may be further understood and appreciated, the preferred embodiments are described below in detail with reference to the related drawings.

BRIEF DESCRIPTION OF THE DRAWINGS

The foregoing objects, features and advantages of the invention will become more apparent from the following detailed description when taken in conjunction with the accompanying related drawings according to exemplary preferred embodiments of a base station antenna protection system and the method thereof of the present invention. In the drawings, same elements are designated with same reference numerals.

DETAILED DESCRIPTION

Exemplary embodiments of the present invention are described herein in the context of the base station antenna protection system and the method thereof.

Those of ordinary skilled in the art will realize that the following detailed description of the exemplary embodiment(s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

Figure 1A:
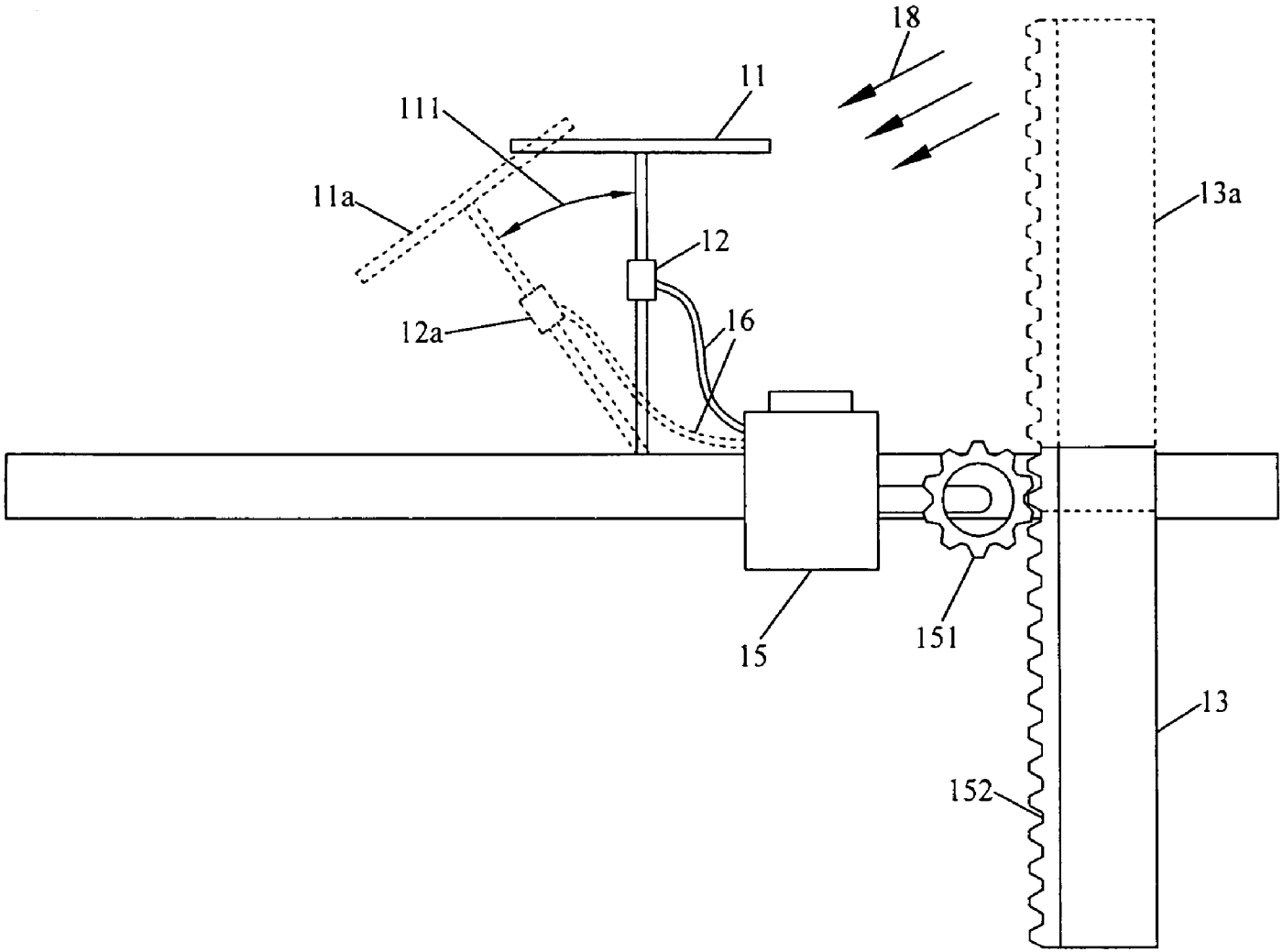
FIG. 1A shows a side view of a base station antenna protection system according to the present invention.
Figure 1B:
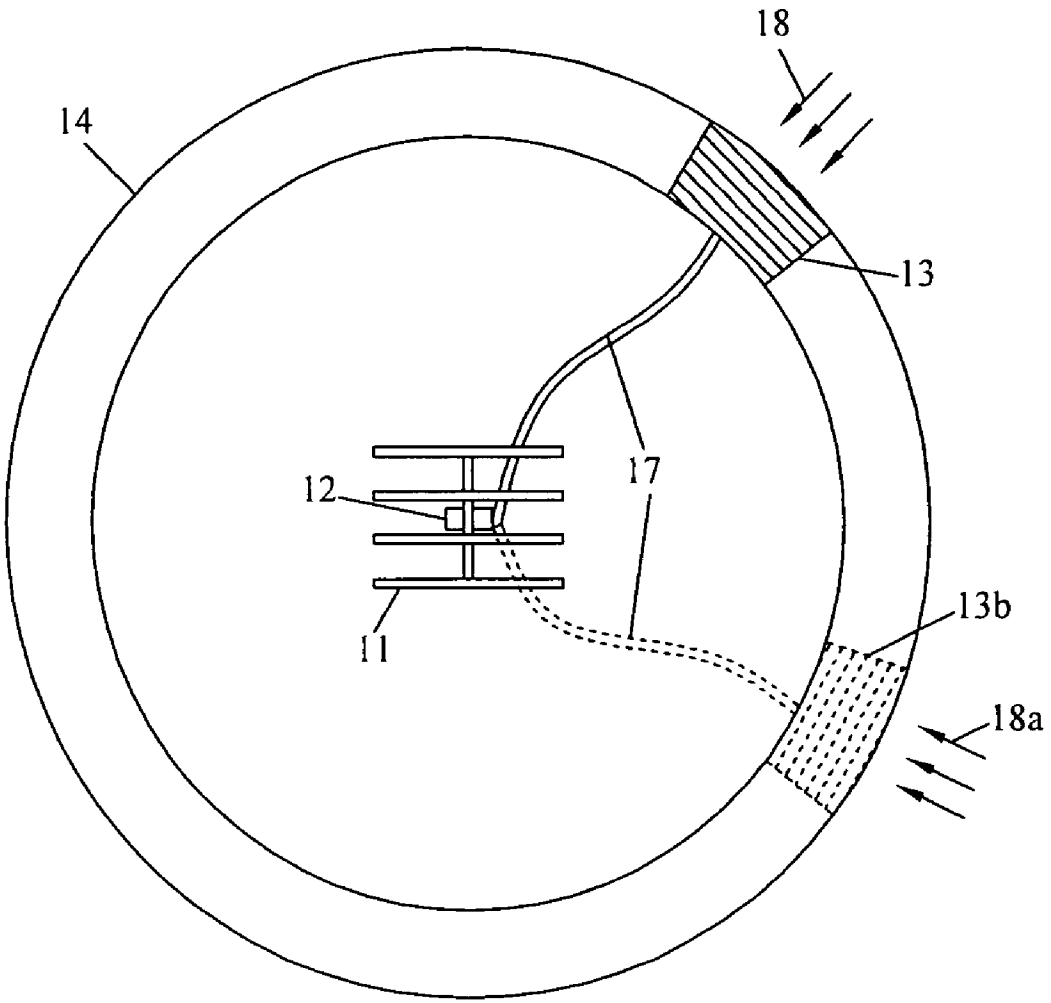
FIG. 1B shows a top view of a base station antenna protection system according to the present invention.

Referring to both FIGS. 1A and 1B, there are shown, respectively, a side view and a top view of a base station antenna protection system according to the present invention. In these figures, the base station antenna protection system receives a wind 18 moving in a direction, and mainly comprises a base station antenna 11, a sensor 12, a protective surface 13 and a rotatory device, and may further comprise a lifting device. The sensor 12 may be an accelerometer and is connected to the base station antenna 11 to detect a deviation 111 of the base station antenna 11 on the direction of the wind 18. The deviation 111 is along the direction of the wind or in close proximity with the direction of the wind. For example, the base station antenna 11 is tilted by the force of the wind 18 and its direction to the position of the base station antenna 11*a* and the sensor 12 is thus located at the position of the sensor 12*a* such that the deviation 111 occurs between the positions of the base station antenna 11 and the base station antenna 11*a*.

Furthermore, a side of the protective surface 13 is opposite to the base station antenna 11 and is connected to the sensor 12 through a connecting line 17. The protective surface 13 is preferably a rotatable protective wall, which is usually designed as a surface and is rotated to cause another side of the protective surface 13 to be opposite to the wind 18 so as to save costs. In addition, the rotatory device is connected to or supports the protective surface 13, and the rotatory device is preferably a rotatory track 14. When the deviation 111 exceeds a predetermined value, it is indicated that the wind 18 is too high such that the base station antenna 11 may be damaged. The sensor 12 is connected to the lifting device via a connecting line 16 such that the motor 15, the gear wheel 151 and the rack 152 of the lifting device begin to operate and the protective surface 13 is lifted to the position of the protective surface 13*a*. Next, the deviation of the center of gravity of the base station antenna 11 detected by the sensor 12 drives the rotatory track 14 to cause another side of the protective surface 13 to be opposite to the wind 18 so as to protect the base station antenna 11 against the wind 18 and return the base station antenna 11 to its original position.

Moreover, when the direction of the wind 18 changes, for example, the direction of the wind 18 may be changed to the direction of the wind 18*a*, the protective surface 13 will be automatically rotated by the rotatory track 14 to the position of the protective surface 13*b* against the direction of the wind 18*a* so as to protect the base station antenna 11*a* against the wind 18*a*. In addition, when the deviation 111 is less than the predetermined value, it is shown that the wind 18 or the wind 18*a* has decreased. At this time, the motor 15, the gear wheel 151 and the rack 152 of the lifting device operates again to lower the protective surface 13 from the position of the protective surface 13*a* to its original position so as to avoid the possible influence of the protective surface 13 on the wireless signals received and transmitted via the base station antenna 11.

Figure 2:
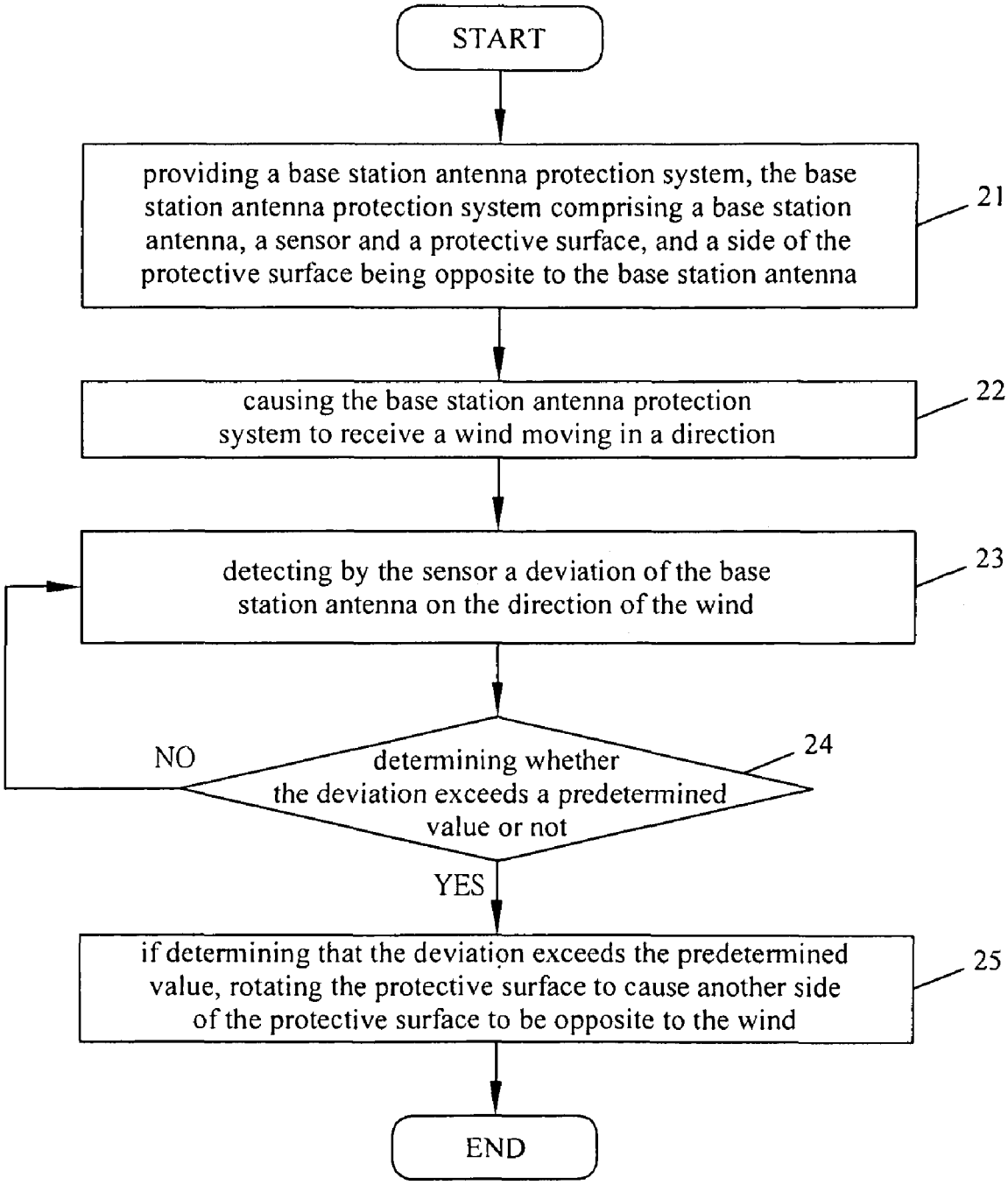
FIG. 2 shows a flow chart of a base station antenna protection method according to the present invention.

Referring to FIG. 2, there is shown a flow chart of a base station antenna protection method according to the present invention. In this figure, the method corresponds to the side view and the top view of the base station antenna protection system shown in FIGS. 1A and 1B, and comprises the following steps:

Step 21: Providing a base station antenna protection system that mainly comprises a base station antenna 11, a sensor 12 and a protective surface 13. A side of the protective surface 13 is opposite to the base station antenna 11. And the base station antenna protection system may further comprise a rotatory device and a lifting device.

Step 22: Causing the base station antenna protection system to receive a wind 18 moving in a direction.

Step 23: Detecting by the sensor 12 a deviation 111 of the base station antenna 11 on the direction of the wind 18. And the sensor may be an accelerometer. The deviation 111 is along the direction of the wind or in close proximity with the direction of the wind. For example, the base station antenna 11 is tilted by the force of the wind 18 and its direction to the position of the base station antenna 11*a* and the sensor 12 is thus displaced to the position of the sensor 12*a* such that the deviation 111 occurs between the positions of the base station antenna 11 and the base station antenna 11*a*.

Step 24: Determining whether the deviation 111 exceeds a predetermined value or not.

Step 25: If determining that the deviation exceeds the predetermined value, rotating the protective surface 13 to cause another side of the protective surface 13 to be opposite to the wind 18.

It should be noted that the protective surface 13 is preferably a rotatable protective wall, which is usually designed as a surface and is rotated to a position against the direction of the wind 18 so as to save costs. The rotatory device is preferably a rotatory track 14. When the deviation 111 exceeds a predetermined value, it is indicated that the wind 18 is too strong such that the base station antenna 11 may be damaged. The protective surface 13 is lifted by the lifting device to the position of the protective surface 13*a*. Next, the rotatory track 14 rotates the protective surface 13 to cause another side of the protective surface 13 to be opposite to the wind 18 so as to protect the base station antenna 11 against the wind 18 and return the base station antenna 11 to its original position.

Additionally, when the direction of the wind 18 changes, for example, the direction of the wind 18 is changed to the direction of the wind 18*a*, the protective surface 13 will be automatically rotated by the rotatory track 14 to the position of the protective surface 13*b* against the direction of the wind 18*a* so as to protect the base station antenna 11*a* against the wind 18*a*. Furthermore, when the deviation 111 is less than the predetermined value, it is shown that the wind 18 or the wind 18*a* has decreased.

At this time, the motor 15, the gear wheel 151 and the rack 152 of the lifting device operates again to lower the protective surface 13 from the position of the protective surface 13*a* to its original position so as to avoid the possible influence of the protective surface 13 on the wireless signals received and transmitted via the base station antenna 11.

The above description is illustrative only and is not to be considered limiting. Various modifications or changes can be made without departing from the spirit and scope of the invention. All such equivalent modifications and changes shall be included within the scope of the appended claims.

What is claimed is:

1. A base station antenna protection system that receives a wind moving in a direction, the system comprising:

a base station antenna; a sensor coupled to the base station antenna to detect a deviation of the base station antenna on the direction of the wind; a protective wall having a surface facing the base station antenna; and a rotatory device coupled to the protective wall, wherein when the deviation exceeds a predetermined value, the rotatory device rotates the protective wall around the base station antenna to cause another side of the protective wall to face the wind.

2. The base station antenna protection system according to claim 1, wherein the protective wall is a rotatable protective wall.

3. The base station antenna protection system according to claim 1, wherein the rotatory device comprises a rotatory track.

4. The base station antenna protection system according to claim 1, further comprising a lifting device used for lifting or lowering the protective wall.

5. The base station antenna protection system according to claim 4, wherein the lifting device comprises a motor, a gear wheel and a rack.

6. A base station antenna protection method comprising steps of:

providing a base station antenna protection system, the base station antenna protection system comprising a base station antenna, a sensor and a protective wall, and a side of the protective wall facing the base station antenna; causing the base station antenna protection system to receive a wind moving in a direction; detecting by the sensor a deviation of the base station antenna on the direction of the wind; determining whether the deviation exceeds a predetermined value or not; and if determining that the deviation exceeds the predetermined value, rotating the protective wall around the base station antenna to cause another side of the protective wall to face the wind.

7. The base station antenna protection method according to claim 6, wherein the protective wall comprises a rotatable protective wall.

8. The base station antenna protection method according to claim 6, wherein the base station antenna protection system further comprises a rotatory device used for rotating the protective wall.

9. The base station antenna protection method according to claim 8, wherein the rotatory device comprises a rotatory track.

10. The base station antenna protection method according to claim 8, wherein the rotatory device is driven according to a detected deviation of the center of gravity of the base station antenna.

11. The base station antenna protection method according to claim 6, wherein the base station antenna protection system further comprises a lifting device used for lifting or lowering the protective wall.

12. The base station antenna protection method according to claim 11, wherein the lifting device comprises a motor, a gear wheel and a rack.

* * * * *